US005669622A

United States Patent [19]

Miller

[11] Patent Number: 5,669,622

[45] Date of Patent: Sep. 23, 1997

[54] SKI BINDING

[76] Inventor: Michael E. Miller, R.R. 1 Box 4080, Killington, Vt. 05751

[21] Appl. No.: 385,343

[22] Filed: Feb. 8, 1995

[51] Int. Cl.[6] ..... A63C 9/00

[52] U.S. Cl. ..... 280/615; 280/619

[58] Field of Search ..... 280/619, 614, 280/615, 626, 628, 623, 631, 632, 634

[56] References Cited

FOREIGN PATENT DOCUMENTS 59664 7/1938 Norway ..... 280/619

185444 7/1936 Switzerland ..... 280/619

185446 7/1936 Switzerland ..... 280/619

*Primary Examiner*—Richard M. Camby

*Attorney, Agent, or Firm*—St. Onge Steward Johnston & Reens LLC

[57] ABSTRACT

The invention provides a ski binding comprising a toe piece and a cable tensioned around a heel of the boot to a position below a sole of the boot at the toe, providing a rebound force for returning the boot heel to the ski without preventing the boot heel from being lifted off the ski.

19 Claims, 5 Drawing Sheets

SKI BINDING

FIELD OF THE INVENTION

The invention relates to ski bindings and more particularly to bindings for nordic and/or telemark type skis upon which only a toe portion of a boot is mounted.

BACKGROUND OF THE INVENTION

Alpine ski bindings firmly hold the boot heel to the ski, to improve ski edge control which may be important at high speeds or on hard surfaces. The bindings used on nordic and/or telemark skis, however, necessarily permit movement of the boot heel up off of the ski, e.g. to permit propulsion and gliding of nordic skis and to permit turning of telemark skis.

The 75 mm binding is well known and widely used on nordic and telemark skis. The 75 mm binding includes 3 pins which fit into corresponding holes in the boot toe sole and a clamp mechanism presses and holds the boot toe sole in place over the pins. The 75 mm binding is not connected to the boot heel and includes no means for urging the boot heel down onto the ski to promote edge control.

The NNN BC is another well known binding for nordic and telemark skis. The NNN BC binding includes jaws which snap closed around a metal bar molded into the boot toe sole. Similar to the 75 mm binding, the NNN BC is not connected to the boot heel and also includes no means for urging the boot heel down onto the ski to promote edge control.

The invention may be used together with the 75 mm binding (see FIG. 6) or the NNN BC binding (see FIGS. 1–3) to modify and improve the performance of either. Additionally, it is understood that the invention may be used with any other means for connecting a boot toe to a ski.

Prior art cable bindings (see FIG. 7) generally include a toe piece similar to a 75 mm binding and a cable led around the boot heel and tensioned by a latch. The cable is led through a guide connected to the toe piece at a position substantially above a top surface of the ski. In use during lifting of the boot heel, the cable rises above the boot sole and tends to promote flexing of the boot sole which lifts the boot heel away from the ski (see FIG. 8). Prior cable bindings generally include no means for urging the boot heel down onto the ski to promote edge control.

The Voilé plate telemark binding includes a 75 mm toe piece and a thin plate of semi-rigid material connected thereto which passes beneath the boot sole and clips to the boot heel to improve torsional stability so the boot heel does not slip sideways off the ski. The Voilé plate, however, also includes no means for urging the boot heel down onto the ski to promote ski edge control.

What is desired, therefore, is a nordic/telemark ski binding that permits the boot heel to be lifted off of the ski for turning and gliding yet which also connects the boot heel to the ski and includes means for urging the boot heel down onto the ski for improved ski edge control.

SUMMARY OF THE INVENTION

Accordingly, it is an object of the invention to provide a ski binding which permits the boot heel to be raised from the ski but includes means for urging the boot heel down onto the ski.

It is a further object of the invention to provide a ski binding of the type described above in which the urging means provides a stronger force for returning the boot heel toward the ski the farther the boot heel is lifted away from the ski.

It is another object of the invention to provide a ski binding of the type described above including a cable fitting over the boot heel and tensioned toward a direction below the boot sole.

Still another object of the invention is to provide a ski binding of the type described above in which when the boot heel is raised the cable travels beneath the boot sole.

Yet another object of the invention is to provide a ski binding of the type described above including a cable guide for controlling a position toward which the heel cable is tensioned.

Yet still another object of the invention is to provide a ski binding of the type described above including a spacer template for mounting beneath a toe piece to locate the toe piece and cable guide at a predetermined location relative to each other.

The ski binding of the invention comprises means for connecting a toe of the boot to the ski, a cable tensioned around a heel of the boot, and a cable guide for receiving the cable at a position below the boot sole to provide a force urging the boot heel down onto the ski.

Preferably, a template is used to mount the toe connecting means in a fixed position relative to the cable guide. The cable guide preferably comprises a plate having an edge extending beyond a width of the ski and bent downwardly to receive the cable thereunder. Most preferably, the plate edge is also bent inwardly forming a track to retain the cable therein.

Preferably the boot sole is raised up off the ski surface and the cable is tensioned toward a position at the ski top surface. The toe connecting means may be a 75 mm toe piece, an NNN BC toe piece, or any other binding system which attaches the boot to the ski by the toe only, such as Salomon.

The invention and its particular features and advantages will become more apparent from the following detailed description considered with reference to the accompanying drawings.

DETAILED DESCRIPTION OF THE INVENTION

Figure 1:
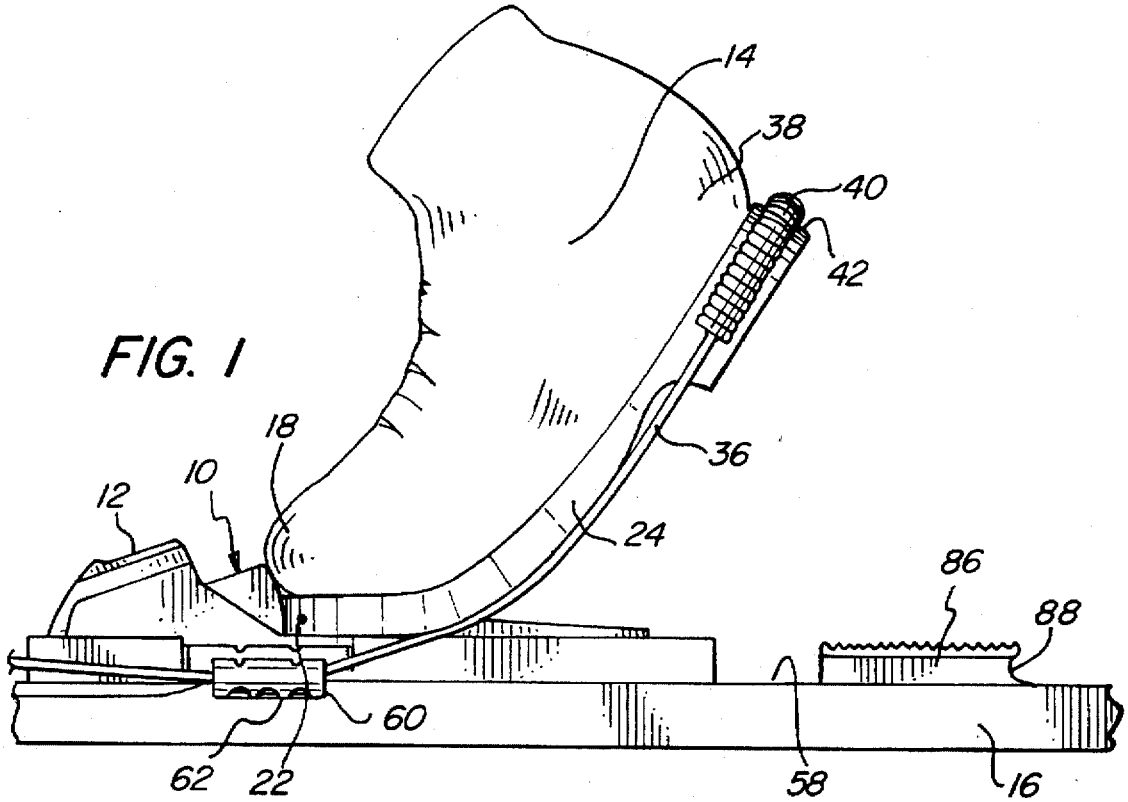
FIG. 1 is a side view of the ski binding of the invention adapted to an NNN BC toe piece and mounted on a ski, and with the boot heel raised as in use.
Figure 2:
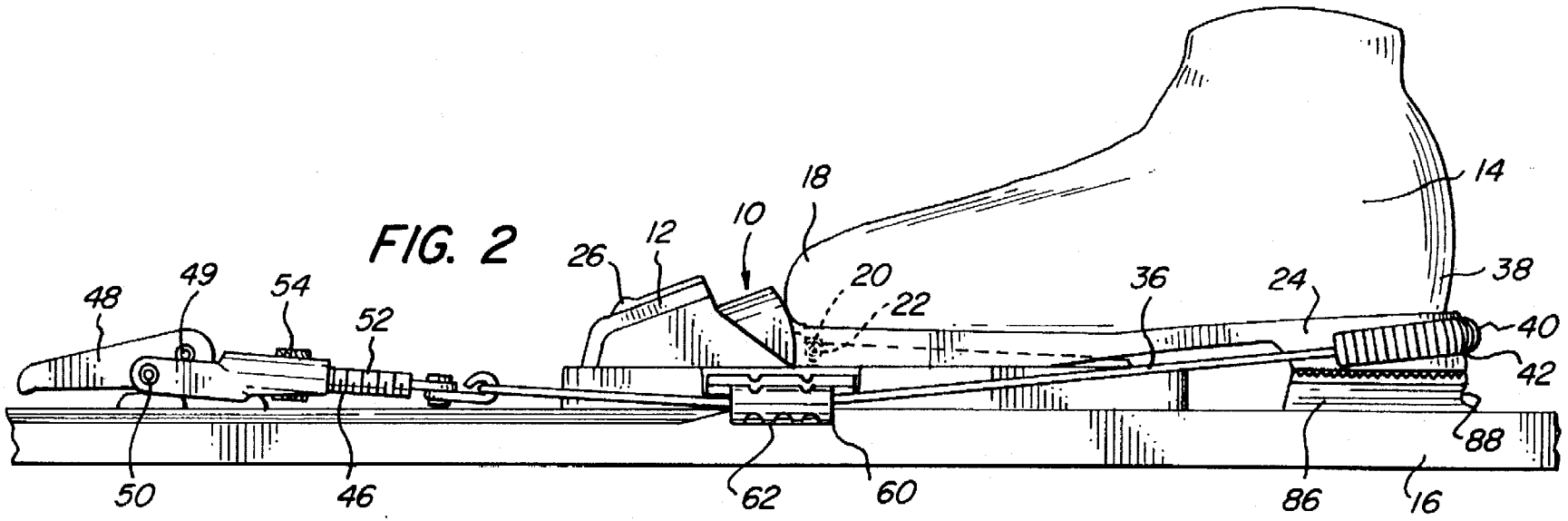
FIG. 2 is a side view of the ski binding of FIG. 1 shown with the boot heel resting on the ski.
Figure 3:
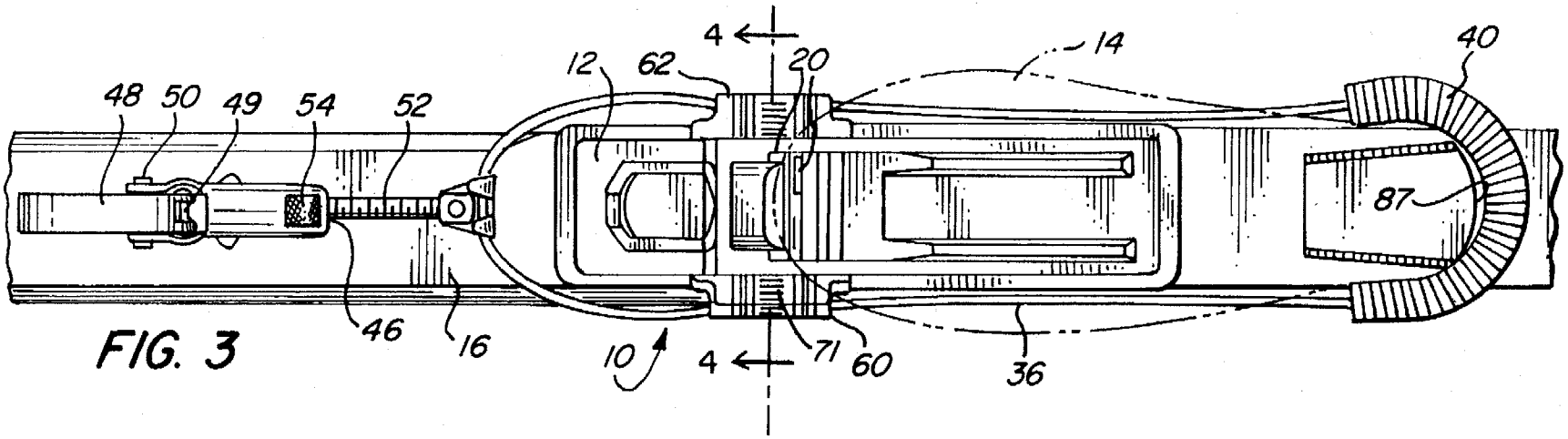
FIG. 3 is a top view of the ski binding of FIG. 1 shown with the boot heel resting on the ski as in FIG. 2.

FIGS. 1–3 and 6 depict a ski binding 10 in accordance with the invention for mounting a boot 14 to a ski 16. In FIGS. 1–3, binding 10 is adapted for use with an NNN BC toe piece 12 and in FIG. 6, binding 10 is adapted for use with a 75 mm toe piece 13. Toe pieces 12, 13 both comprise means for connecting toe 18 of boot 14 to ski 16. It is understood that other toe connecting means, not illustrated herein, may also be used without departing from the scope of the invention.

Referring to FIGS. 1–3, NNN BC toe piece 12 comprises a spring-loaded jaws 20 (see FIGS. 2–3) for removably clasping around a bar 22 molded into sole 24 of boot 14 near toe 18. A retractable lever 26 permits closure and release of jaws 20. Toe piece 12 is commercially available from Rottefella of Norway.

Figure 6:
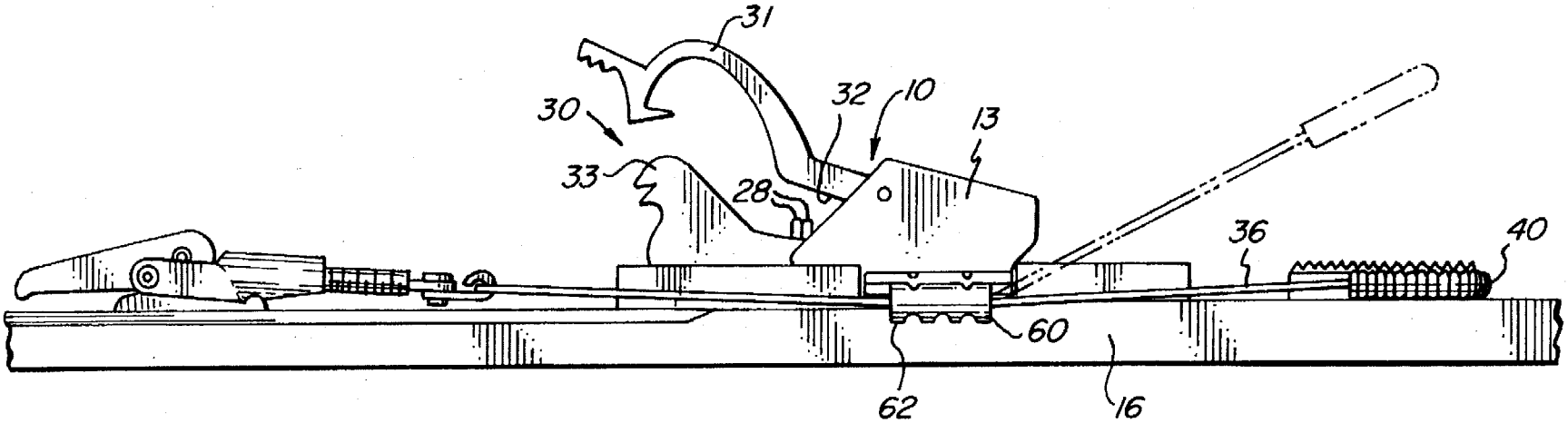
FIG. 6 is a side view of the ski binding of the invention adapted to a 75 mm toe piece and mounted on a ski.

Referring now to FIG. 6, 75 mm toe piece 13 comprises a set of pins 28, which are received within corresponding holes (not shown in any Figure) in the soles of the ski boot, and a clamp mechanism 30 for clamping the ski boot sole over the pins. Clamp mechanism 30 includes a pivot arm 31 and a latch 33 for releasably locking the pivot arm. A lower portion 32 of clamp mechanism 30 contacts an upper portion 34 of the boot sole near the toe to clamp the boot toe to the ski (see FIGS. 7–8). Toe piece 13 is also commercially available from Rottefella, as well as other manufacturers. Other so-called 75 mm toe pieces include no pins at all, only non moving clamp surfaces under which the boot toe sole is wedged by a heel cable.

In addition to a toe piece, binding 10 comprises a cable 36 tensioned around a heel 38 of boot 14 at sole 24. Cable 36 includes a boot engaging portion 40 having a large enough diameter to sufficiently distribute the load applied by the cable to the boot to reduce undue wear on the boot sole. Boot engaging portion 40 is preferably a spring or like device capable of a small amount of longitudinal expansion. Boot heel 38 includes a hollow 42 for receiving boot engaging portion 40 therein.

A fitting 44 attaches cable 36 to a connecting rod 46 which is itself connected to a crank arm 48 by a crank pin 50. Crank arm 48 is pivotably mounted at pivot point 49 to ski 16 forward of toe piece 12, 13. Cable 36 is tensioned by pivoting crank arm 44 forwardly to throw connecting rod 46 over pivot point 49. Connecting rod 46 includes a threaded portion 52 and may be shortened or lengthened with a thumb wheel 54 to adjust the amount of tension applied to cable 36 by crank arm 48. As with the NNN BC toe piece and the 75 mm toe piece, cable 36 and the tensioning mechanism are commercially available from Rottefella of Norway. It is understood that in other embodiments, cable 36 may be terminated at and/or pivotably mounted to the toe piece, and may be tensioned at the heel or side of the boot.

Figure 7:
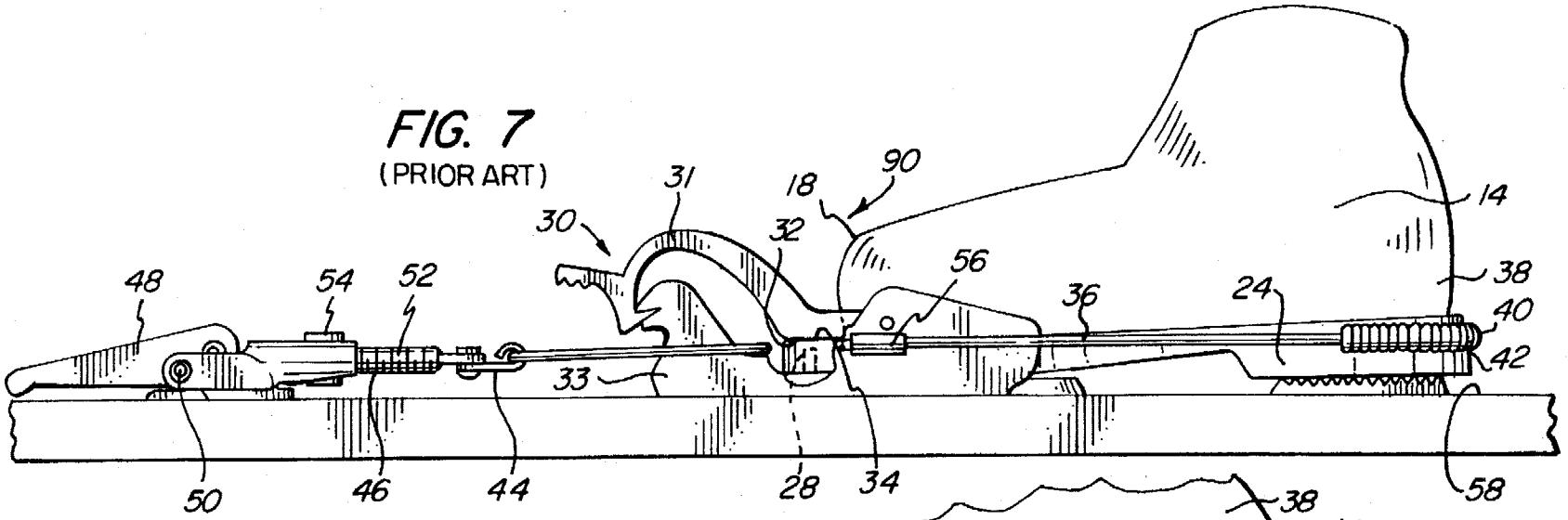
FIG. 7 (PRIOR ART)
FIG. 7 and 8 are side views of a prior art ski cable binding with a 75 mm toe piece.
Figure 8:
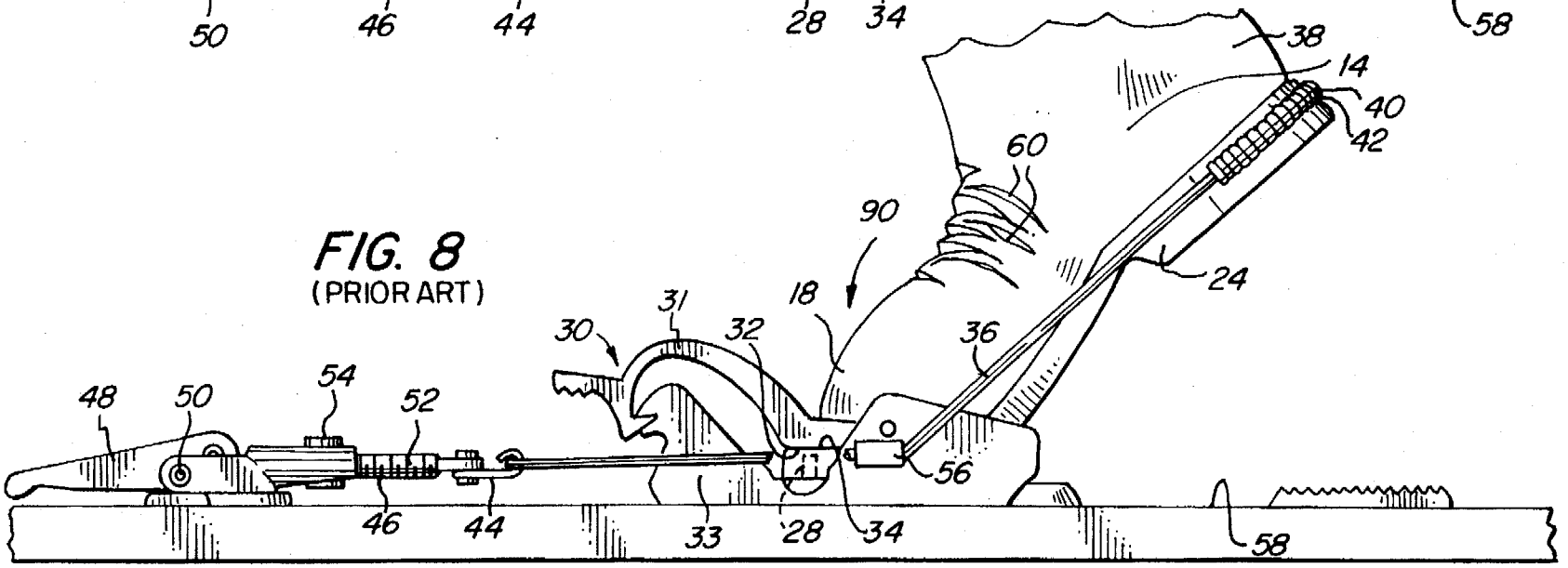
FIG. 8 (PRIOR ART)

Referring now to FIGS. 7–8, a prior art cable binding 90 is illustrated. Binding 90 includes both a toe piece 30 and a tensioned cable 36. However, bindings 90 and 10 differ significantly with respect to the position and direction toward which cable 36 is tensioned, and it is this difference which forms the basis for the invention.

In binding 90, cable 36 is tensioned from boot heel 38 in a direction and toward a position 56 which is above a top surface 58 of ski 16, is at or above boot sole 24, and is at the side of the toe piece (see FIG. 7). In use, as shown in FIG. 8, cable 36 thus travels above boot sole 24 such that the tension in cable 36 promotes flexing of the boot sole (shown as crease marks 60 in the boot upper) and provides a force for raising the boot sole off ski top surface 58. This disadvantageously reduces edge control of telemark skis.

Referring again to FIGS. 1–3 and 6, in binding 10, cable 36 is tensioned in a direction and toward a position 60 which is at or below top surface 58 of ski 16, is below sole 24 of boot 14 and is below toe piece 12, 13. A cable guide 62 is located at position 60 for receiving cable 36 thereunder to control the direction and position toward which it is tensioned. Cable guide 62 is mountable together with toe piece 12, 13 and may but need not be integrated with toe piece 12, 13. Thus 30 the invention may sold in the after market for addition to toe piece 12, 13, or the invention may be sold as a single integral unit with the toe piece as original equipment.

Because cable 36 is tensioned downwardly from heel 38 toward toe 18 with respect to boot 14, cable 36 necessarily provides a force urging boot heel 38 down onto top surface 58 of ski 16 (see FIG. 2). Further, because cable 36 travels beneath boot sole 24, when boot heel 38 is raised off of ski top surface 58, e.g. to turn telemark skis, boot sole flex is minimized (note minimal crease marks in FIG. 1 boot upper) and cable tension increases. This increase in cable tension provides an increased force urging the boot heel back onto the ski and provides a "rebound" effect which tends to bounce the boot heel back down onto the ski for maximum edge control. It is understood that the rebound force or bounce increases as the boot heel is lifted further and further off of ski top surface 58.

Figure 4:
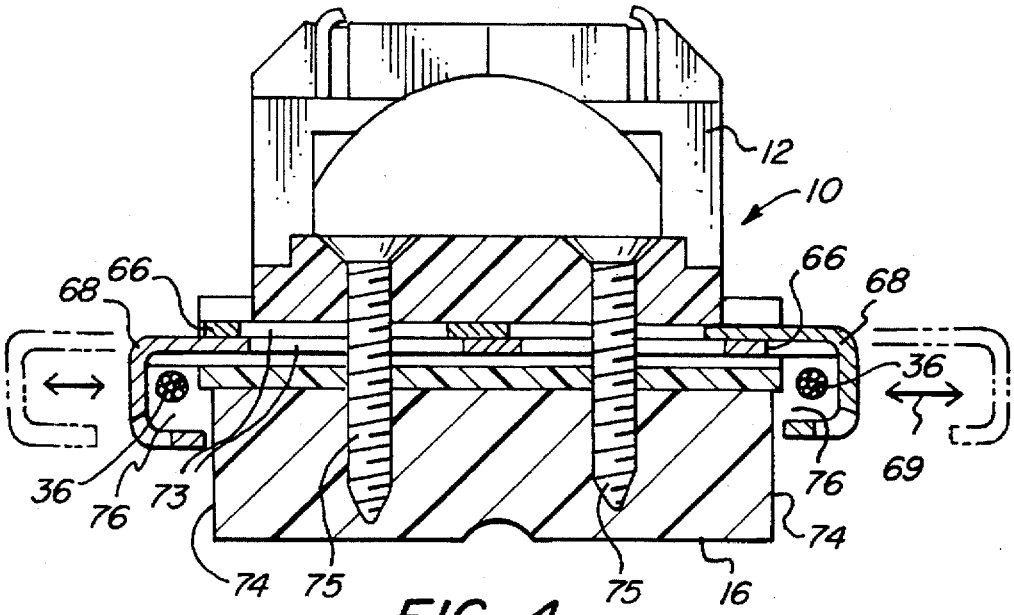
FIG. 4 is a cross sectional view of the ski binding of FIG. 1 taken along the plane 4—4 of FIG. 3 illustrating the cable guides, toe piece and binding template.
Figure 5:
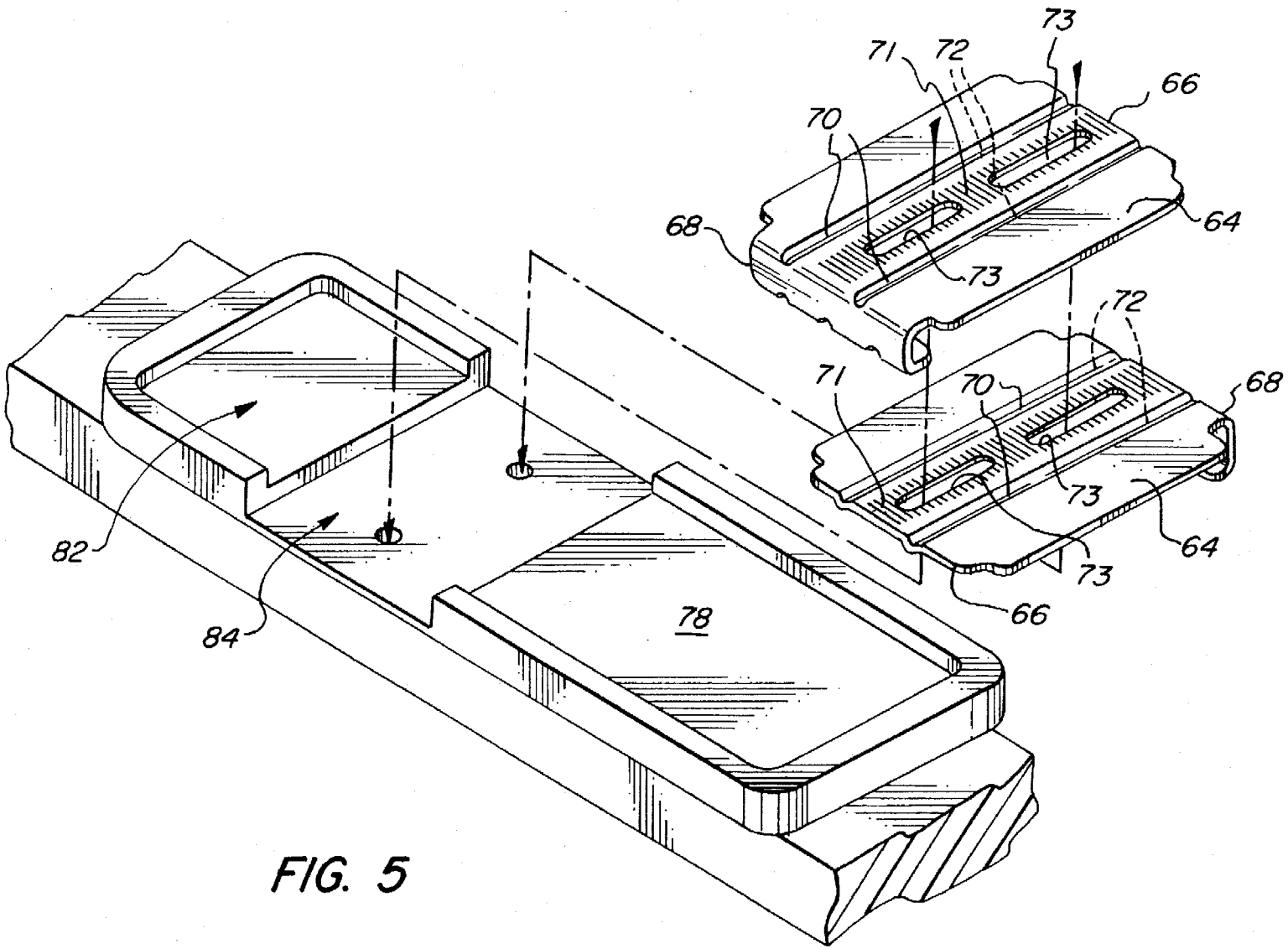
FIG. 5 is a front isometric view of the template and cable guides of the ski binding of FIG. 1.

Referring now also to FIG. 5, cable guide 62 comprises a pair of plates 64 each having an inner edge 66, an outer edge 68, a groove 70 and a ridge 72. Ridges 72 and grooves 70 of plates 64 are sized to fit within one another for aligned sliding of the plates (see arrow 69 in FIG. 4) together and apart to accommodate skis having different widths. Upon selection of the proper width, surface serrations 71 in plates 64 hold the plates together in a frictional fit until they can be mounted to ski 16 with fasteners 75 through slots 73 (see FIG. 5).

Plates 64 are each about 3/32–4/32 inches thick (including ridge 32), and thus when they are mounted together beneath toe piece 12, 13, they effectively raise the toe piece up off top surface 58 of ski 16 by about 3/16–4/16 inches. It has been found that when cable 36 is tensioned to a position at about the ski top surface, the boot sole must be raised by about these 3/16–4/16 inches to provide the ideal rebound force which is not so great as to either prevent the boot heel from being raised off the ski to initiate a turn, or cause the cable to pop off of the boot heel.

Outer edges 68 of plates 64 are bent downwardly and inwardly toward a side surface 74 of ski 16 when mounted thereon to provide a passageway or track 76 (see FIG. 4) through which cable 36 may travel at position 60. In this regard, track 76 retains cable 36 against side surface 74 of ski 16. When plates 64 are used with a template (discussed below), track 76 retains cable 36 against the ski side surface and the template side surface.

Especially where binding 10 is intended to be sold in the aftermarket, a template 78 provides the precise amount of boot lift, and the precise alignment of toe piece 12, 13 and cable guide 62 as necessary for optimum performance. It is understood that different templates 78 may need to be designed and used for different toe pieces. It is also understood that boot sole need not be lifted quite as much in the case where position 60 is located below top surface 58 of ski 16, and that when position gets below top surface 58 there is a risk on some types of skis that plate edges 68 will interfere with ski 16 edges.

Template 78 includes a recess 84 for receiving plates 64 therein a fixed position, and also includes a recess 82 for receiving toe piece 12, 13 therein in a fixed position with respect to plates 64. Recesses 82, 84 are both on a top surface of the illustrated template, however it is understood that they need not be in order to accommodate the dimensions of a particular toe piece.

Template 78 raises boot toe 18 the proper amount, and a spacer 86, illustrated in FIGS. 1–2, raises boot heel 38 a corresponding amount. Spacer 86 has a curved rearward edge 87 (see FIG. 3) and a hollow 88 (see FIGS. 1–3) which coordinately function to hold and store cable 36 when not in use (see FIG. 6).

Although the invention has been described with reference to a particular arrangement of parts, features and the like, these are not intended to exhaust all possible arrangements or features, and indeed many other modifications and variations will be ascertainable to those of skill in the art.

What is claimed is:

1. A binding for mounting a boot to a ski, comprising:

means for fixedly connecting a toe of the boot to the ski;

a cable tensioned around a heel of the boot yet permitting the boot heel to be raised off of the ski; and a cable guide, mountable together with said toe connecting means, for controlling a direction toward which said cable is tensioned, said cable guide for receiving said cable therein at a position below said toe connecting means to generate increasing cable tension, urging the boot heel back down onto the ski as it is raised off the ski.

2. The binding of claim 1 including a template for mounting said boot toe connecting means and said cable guide to the ski, said template including a first recess for receiving said toe connecting means therein and a second recess for receiving said cable guide therein in a position fixed with respect to said toe connecting means.

3. The binding of claim 2 wherein said cable guide comprises a plate having an edge extending beyond a width of the ski, said edge bent downwardly for receiving said cable thereunder.

4. The binding of claim 3 wherein said edge is bent downwardly and inwardly toward the ski to retain said cable between said plate and a side surface of the ski.

5. The binding of claim 4 wherein said plate is slidably mountable for adjustment of said edge to accommodate different width skis.

6. The binding of claim 4 wherein said first and second recesses are both on a top surface of said template.

7. The binding of claim 6 wherein said edge retains said cable between said plate, the side surface of said ski and said template.

8. The binding of claim 7 wherein said toe connecting means comprises an NNN BC toe piece.

9. The binding of claim 7 wherein said toe connecting means comprises a 75 mm toe piece.

10. A binding for mounting a boot to a ski comprising:

means for fixedly connecting a toe of the boot to the ski;

a cable tensioned around a heel of the boot yet permitting the boot heel to be raised off of the ski; and a cable guide, mountable together with said toe connecting means, for controlling a position toward which said cable is tensioned, said cable guide for receiving said cable therein below said boot sole to generate increasing cable tension, urging the boot heel back down onto the ski as it is raised off the ski.

11. The binding of claim 10 including a template for mounting said boot toe connecting means and said cable guide to the ski, said template including a first recess for receiving said toe connecting means therein and a second recess for receiving said cable guide therein in a position fixed with respect to said toe connecting means.

12. The binding of claim 10 wherein said cable guide comprises a plate having an edge extending beyond a width of the ski, said edge bent downwardly for receiving said cable thereunder.

13. The binding of claim 11 wherein said edge is bent downwardly and inwardly toward the ski to retain said cable between said plate and a side surface of the ski.

14. The binding of claim 12 wherein said plate is slidably mountable for adjustment of said edge to accommodate different width skis.

15. The binding of claim 14 wherein said toe connecting means comprises an NNN BC toe piece.

16. The binding of claim 14 wherein said toe connecting means comprises a 75 mm toe piece.

17. A binding for mounting a boot to a ski comprising:

means for fixedly connecting a toe of the boot to the ski;

a cable tensioned around a heel of the boot yet permitting the boot heel to be raised off of the ski; and a cable guide mounted together with said toe connecting means and extending beyond a width of the ski, said cable guide having an edge bent downwardly for receiving said cable thereunder to control a position toward which said cable is tensioned, said cable passing thereunder at a position below said boot sole and passing beneath the boot sole to generate increasing cable tension, urging the boot heel back down onto the ski as it is raised off the ski.

18. The binding of claim 17 wherein said cable guide extends to a position below a surface of the ski.

19. The binding of claim 18 wherein said cable guide is movably mountable for adjustment of said cable guide to accommodate different width skis.

* * * * *

US005669622B1

(12) REEXAMINATION CERTIFICATE (4428th)

United States Patent

Miller

(10) Number: US 5,669,622 C1

(45) Certificate Issued: Aug. 28, 2001

(54) SKI BINDING

(75) Inventor: Michael E. Miller, R.R. 1 Box 4080, Killington, VT (US) 05751

(73) Assignee: Michael E. Miller, Killington, VT (US)

Reexamination Request:
No. 90/004,991, May 22, 1998

Reexamination Certificate for:

| | |
|---|---|
| Patent No.: | **5,669,622** |
| Issued: | **Sep. 23, 1997** |
| Appl. No.: | **08/385,343** |
| Filed: | **Feb. 8, 1995** |

(51) Int. Cl.[7] ..... A63C 9/00

(52) U.S. Cl. ..... 280/615; 280/619; D21/773

(58) Field of Search ..... 280/619, 614, 280/615, 626, 628, 623, 631, 632, 634

(56) References Cited

U.S. PATENT DOCUMENTS

| | | |
|---|---|---|
| D. 390,901 | 2/1998 | Hauglin . |
| 1,553,475 | 9/1925 | Schiess . |
| 2,183,171 | 12/1939 | Refsdal . |
| 2,199,444 | 5/1940 | Rauglas . |
| 2,253,889 | 8/1941 | Carroll . |
| 2,276,252 | 3/1942 | Nashe et al. . |
| 2,314,270 | 3/1943 | Elliott . |
| 2,600,688 | 6/1952 | Reuge . |
| 2,661,957 | 12/1953 | Attenhofer . |
| 2,673,743 | 3/1954 | Gould . |
| 3,877,712 | 4/1975 | Weckeiser . |
| 4,029,336 | 6/1977 | Haimerl . |
| 5,499,838 | 3/1996 | Hauglin et al. . |
| 5,669,622 | 9/1997 | Miller . |

FOREIGN PATENT DOCUMENTS

| | | |
|---|---|---|
| 185444 | 7/1936 | (CH) . |
| 185446 | 7/1936 | (CH) . |
| 201194 | 11/1938 | (CH) . |
| 246196 | 12/1946 | (CH) . |
| 409731 | 10/1966 | (CH) . |
| 429533 | 7/1967 | (CH) . |
| 671329 | 12/1929 | (FR) . |
| 756374 | 12/1933 | (FR) . |
| 773572 | 11/1934 | (FR) . |
| 813853 | 6/1937 | (FR) . |
| 947025 | 6/1949 | (FR) . |
| 284799 | 2/1928 | (GB) . |
| 29879 | 7/1919 | (NO) . |
| 59664 | 7/1938 | (NO) . |
| 1200920 | 12/1985 | (SE) . |

OTHER PUBLICATIONS

Rottefella, "Rottefella Products 1994," front and back cover, pp. 2–11.

*Primary Examiner*—Richard M. Camby

(57) ABSTRACT

The invention provides a ski binding comprising a toe piece and a cable tensioned around a heel of the boot to a position below a sole of the boot at the toe, providing a rebound force for returning the boot heel to the ski without preventing the boot heel from being lifted off the ski.

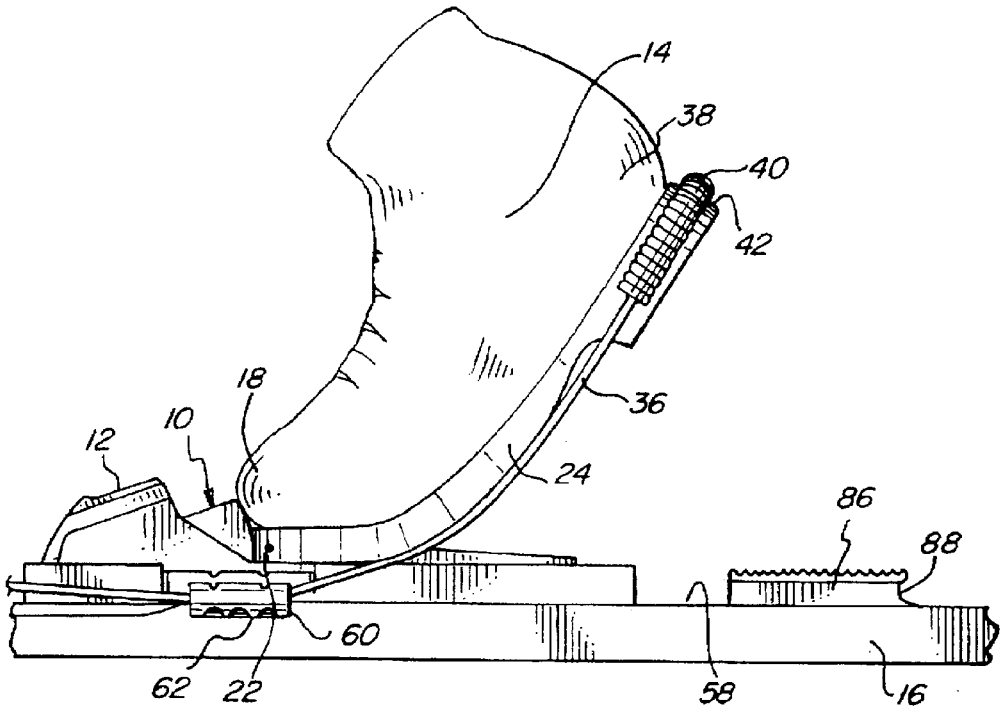

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19 are cancelled.

* * * * *